US005154845A

United States Patent [19]

Williams

[11] Patent Number: 5,154,845

[45] Date of Patent: Oct. 13, 1992

[54] FLUORINE CONTAINING LUBRICATING COMPOSITION FOR RELATIVELY MOVING METAL SURFACES

[75] Inventor: John R. Williams, Lexington, Mass.

[73] Assignee: PCR Group, Inc., Gainesville, Fla.

[21] Appl. No.: 752,285

[22] Filed: Aug. 23, 1991

Related U.S. Application Data

[63] Continuation of Ser. No. 512,556, Apr. 11, 1990, abandoned, which is a continuation of Ser. No. 265,283, Oct. 26, 1988, abandoned, which is a continuation of Ser. No. 83,242, Aug. 10, 1987, abandoned.

[51] Int. Cl.[5] ..... C10M 111/04

[52] U.S. Cl. ..... 252/54; 252/48.4; 252/49.6; 252/49.9; 252/51.5 R

[58] Field of Search ..... 252/48.4, 49.6, 411.9, 252/51.5 R, 54, 58

[56] References Cited

U.S. PATENT DOCUMENTS

| | | | |
|---|---|---|---|
| 3,242,218 | 3/1966 | Miller . | |
| 3,283,012 | 11/1966 | Day . | |
| 3,306,853 | 2/1967 | Fogg et al. . | |
| 3,306,854 | 2/1967 | Gumprecht . | |
| 3,306,855 | 2/1967 | Borecki . | |
| 3,367,868 | 2/1968 | Skehan . | |
| 3,445,392 | 5/1969 | Gumprecht et al. . | |
| 3,505,229 | 4/1970 | Skehan . | |
| 3,536,624 | 10/1970 | Christian et al. | 252/54 |
| 3,784,471 | 1/1974 | Kaiser | 252/58 |
| 3,901,700 | 8/1975 | Yoerger et al. . | |
| 3,965,148 | 6/1976 | Kleiner et al. . | |
| 4,174,461 | 11/1979 | Sianesi et al. | 252/54 |
| 4,438,006 | 3/1984 | Snyder, Jr. et al. | 252/54 |
| 4,438,007 | 3/1984 | Snyder, Jr. et al. | 252/54 |
| 4,443,349 | 4/1984 | Snyder, Jr. et al. | 252/54 |
| 4,529,659 | 7/1985 | Hoshino et al. . | |
| 4,657,687 | 4/1987 | Caporicco et al. | 252/54 |

OTHER PUBLICATIONS

*Webster's Ninth New Collegiate Dictionary,* Merrian-Webster Inc., 1985, p. 535.

*Primary Examiner*—Theodore Morris
*Assistant Examiner*—David M. Brunsman
*Attorney, Agent, or Firm*—Hedman, Gibson & Costigan

[57] ABSTRACT

There is provided a synthetic lubricant composition characterized by the presence therein of (a) a fluorinated polyether and (b) a minor amount of a soluble polyfluoro additive.

13 Claims, 4 Drawing Sheets

FLUORINE CONTAINING LUBRICATING COMPOSITION FOR RELATIVELY MOVING METAL SURFACES

The U.S. Government has a paid-up license in this invention and the right in limited circumstances to require the patent owner to license others on reasonable terms as provided for by the terms of contract No.: N00030-84-C-0036 awarded by the Department of the Navy.

This invention relates to a fluorine-containing lubricating composition, and more particularly to a composition composed of a fluorinated fluid and a polyfluorinated additive compound soluble in the fluid lubricant.

This is a continuation of Ser. No. 512,556, filed Apr. 11, 1990, now abandoned; which is a continuation of Ser. No. 07/265,283 filed Oct. 26, 1988, now abandoned; which is a continuation of Ser. No. 07/083,242, filed Aug. 10, 1987, now abandoned.

BACKGROUND OF THE INVENTION AND PRIOR ART

It is known that at low speeds, i.e., speeds used for life tests, that the surfaces of ball bearings are in a boundary lubrication mode as opposed to a hydrodynamic lubrication mode. The differences between hydrodynamic and boundary lubrication are well established and are briefly summarized as follows. Under hydrodynamic lubrication, the bearing friction is due to the viscosity of the lubricant which completely separates the relatively moving metal surfaces and this occurs at high speeds with low loads. At lower speeds and high loads the metal is separated by a layer of only one or two molecules thickness which is generally less than the dimensions of point asperities, and some degree of metal to metal contact may occur. For this reason, long chained organic molecules are effective boundary lubricants. Greatest protection occurs if the organic lubricant is either a solid adsorbed on the surface or a compound which chemically bonds to the metal surface.

Also of interest is the influence of chain length on the effectiveness of a boundary lubricant. It was shown that the coefficient of friction decreases from 0.18 to 0.05 as the chain length is increased from 6 to 14 carbon atoms. Although the coefficient of friction is a minimum at a chain length of 14 carbon atoms, it does not increase significantly as the chain length is increased further.

It is also noted that the mechanism of lubrication for the boundary condition results in lubricant deformation and shear. That is, the high forces created at the asperities (be they due to shear, temperature, pressure, sudden or shock loading or some other form of energy) result in shear of the lubricating film. This shearing or scission at the molecular level produces, for example in the case of fatty acids, additional organic acids which are themselves beneficial.

In addition to the above, it was determined that it would be beneficial to have a boundary lubricant additive soluble in the fluorinated base oil. Fluorinated fluids, such as perfluoropolyethers are generally considered hydrodynamic, not boundary lubricants. It was determined, therefore, to examine those molecular structures which could function as a boundary lubricant and at the same time be soluble in the fluorinated base oil.

It was found that a structure having a fluorocarbon chain particularly those containing 8 or more carbon atoms for solubilization, and having a functionalized head which was a hydrogen containing moiety having some level of acidity was especially useful.

Reference may be had to U.S. Pat. No. 3,367,868 dated Feb. 6, 1968 for a disclosure of perfluoropolyether lubricants useful in the present invention. The lubricants particularly useful herein have a maximum volatility of 50% at 400° F. according to Federal Test Method Standard -791, method 351 and a maximum pour point of 50° F. These values do not apply to all useful fluorinated lubricating fluids, but apply to the preferred component (a). Other references of interest and relating to these lubricants include U.S. Pat. No. 3,242,218 to Miller; U.S. Pat. Nos. 3,306,853; 3,306,854; 3,306,855 all dated Feb. 28, 1967; U.S. Pat. No. 3,445,392 dated May 20, 1969; U.S. Pat. No. 3,505,229 dated Apr. 7, 1970; U.S. Pat. No. 3,901,700 dated Aug. 26, 1975; U.S. Pat. No. 4,529,659 dated Jul. 16, 1985. The disclosures of these patents insofar as they relate to perfluoro polyether lubricants are incorporated herein by reference.

For reference to various poly- and per-fluorinated compounds useful in carrying out the present invention as component (b) reference may be had to U.S. Pat. No. 3,965,148 dated Jun. 22, 1976. Polyfluorinated alcohols as additives in certain synthetic oils (e.g., di-2-ethylhexyl sebacate) are disclosed as antifriction compounds in an article by Sekiyu et al, Department of Chem. Eng. Tokyo Institute of Technology, Tokyo, Japan (Sekiyu Gakkaishi 1986, 29(2) 183–6). Polyfluorinated alkanols particularly useful in carrying out the present invention are also disclosed in U.S. Pat. No. 3,283,012 dated Nov. 1, 1966.

A principal purpose of this invention is to reduce wear in bearings which are run in an environment of highly fluorinated fluids. These fluids include, but are not limited to perfluoralkyl ethers (marketed under trademarks including AFLUNOX TM, DEMNUM TM (Daikin) KRYTOX TM (DuPont) and FOMBLIN TM (Montedison), perfluoroalkanes, and perfluoroamines (such as 3M's FLUORINERT TM Series and Imperial Smelting Corp's PP Series) and other perfluoro and highly fluorinated compounds.

Utility of compositions containing components (a) and (b) has been demonstrated for ball bearings, but has potential application for other types of bearings and any case where two relatively moving surfaces may otherwise make contact in a highly fluorinated fluid.

Prior art methods employ either no additive lubricant or an additive lubricant insoluble in highly fluorinated fluids. The additives described in this invention are soluble in highly fluorinated fluids.

One prior art method used the highly fluorinated fluid without an additive. However, this resulted in unacceptable wear levels in some systems and variable wear levels in other systems. The other prior art method pretreated the surfaces with a hydrocarbon type lubricant which was not fluorinated. However, hydrocarbon lubricants are virtually insoluble in the highly fluorinated fluids.

The disadvantages of the former methods are that where a two-phase, non-homogeneous system is used, wear occurs. Use of an insoluble lubricant provides only a limited amount of lubricant because that which is applied to the surface during fabrication is the only material available during operation. Through the use of a soluble additive during operation, lubricant is continuously available to the bearing. It is also possible for an insoluble lubricant to be displaced by the highly fluorinated fluid during operation. The step of carefully applying a known amount of lubricant during fabrication can be avoided. If no additive is added then excessive wear occurs.

BRIEF STATEMENT OF THE INVENTION

Briefly stated, the present invention is a lubricating composition of matter characterized by a major amount, i.e., in excess of 50 parts by weight of (a) a highly fluorinated fluid having the general formula:

$$F-\left[\underset{\underset{R}{|}}{CF}-CF_2-O\right]_n-CF_2-CF_3 \qquad (I)$$

wherein n is an integer in the range of from about 10 to about 60 and R is selected from a fluorine atom and a perfluorinated alkyl group having from 1 to 4 carbon atoms and (b) a minor amount, i.e., up to about 50 parts by weight, of a polyfluorinated compound soluble in component (a) containing at least one hydrogen and having a pKa in the range of −1 to 30, preferably in the range of 4–15. Generally, the concentration of component (a) ranges from about 50 parts by weight to 99.9999 parts by weight, and the concentration of component (b) ranges from about 0.0001 part to about 50 parts by weight. Usually components (a) and (b) total 100 parts by weight. In preferred embodiments, component (a) is present in the compositions in an amount ranging from 96 parts to 99.5 parts by weight, and component (b) is present in an amount ranging from 4 parts to 0.5 part by weight.

The term "aliphatic" as used herein is generic and includes alkyl, which means carbon and hydrogen only. The term "aliphatic" includes chain type structures which include one or more oxygen, nitrogen, phosphorus, sulfur, selenium, boron, etc., atoms attached to or interposed between carbon atoms.

In more specific embodiments of the invention, component (a) the perfluoropolyether has the formula II $$F(\underset{\underset{CF_3}{|}}{CFCF_2O})_p(CF_2O)_q(CF_2CF_2O)_rCF_3 \qquad (II)$$

where the value of (p+q+r) ranges from 10–60. Yet another specific embodiment of the invention contemplates a perfluoropolyether of the formula $$F(CF_2CF_2CF_2O)_nCF_2CF_3 \qquad (III)$$

where the value of n ranges from 10–60 for component (a).

An especially useful perfluoropolyether is the Krytox TM -type lubricant as that commercially available from E. I. DuPont de Nemours under the trademark Krytox-143 AZ (See U.S. Pat. No. 4,268,556 dated May 19, 1981). Another especially useful polyfluro oil is 1,1,2,2,3,3,4,4,4-nonafluoro-N,N-bis(nonafluorobutyl)-1-butanamine available commercially from 3M under the trademark Fluorinert FC-43.

In general, the most desirable polyfluoroalkanols contain from 6 to 12 carbon atoms. A preferred soluble polyfluorinated additive compound as component (b) is pentadecafluorooctanol. The concentration of the alcohol is preferably in the range of from 0.5 parts to 10 parts by weight especially 2.5 parts by weight. Other preferred soluble polyfluorinated additive compounds include compounds of the general formula $$F(\underset{\underset{CF_3}{|}}{CFCF_2O})_nCF\underset{\underset{CF_3}{|}}{R}$$

where n=1 to 50 and R=H or $CH_2OH$.

Desirably, the lubricating composition contains only components (a) and (b) although minor amounts of additional materials may be present so long as such material or materials do not adversely affect the ability of the lubricating compositions hereof to function in the desired manner. Less than 10 parts by weight of such additional components, for example, those mentioned in the above in the aforesaid issued patents, may be included in the lubricating compositions.

BRIEF DESCRIPTION OF THE DRAWINGS

The invention may be better understood by having reference to the annexed drawings, wherein.

DETAILED DESCRIPTION OF THE INVENTION

This invention employs a mixture of a highly fluorinated lubricating fluid as component (a) and at least one highly fluorinated soluble additive containing at least one hydrogen atom as component (b). The lubricating fluids used as component (a) include, but are not limited to, perfluoroalkyl ethers such as PCR's AFLUNOX TM, DuPont's KRYTOX TM, Montedison's FOMBLIN TM Y, Montedison's Z, Daikin's Demnum, 3M's Fluorinert series, perfluoro or highly fluorinated alkanes, perfluoro or highly fluorinated amines and perfluoro or highly fluorinated ethers and perfluoro or highly fluorinated esters. The highly fluorinated additives used as component (b) are effective in wide concentrations and may be employed in concentrations as low as 0.0001% with no upper limit on the maximum concentration. Typical concentrations employed are 0.1 to 5% depending upon the specific application. Component (b) may be aromatic or aliphatic or cycloaliphatic and of any chain length with 6 to 20 carbons being typical. The chemical structures of such compounds include, but are not limited to $R_fOH$, $R_fCH_2OH$, $R_fCH_2CH_2OH$ and $R_fCH_2CH_2CH_2OH$ where $R_f$ is a perfluoro or highly fluorinated alkane, ether, amine or ester which may be linear or branched to any degree, aliphatic or cycloaliphatic or aromatic.

In addition to terminal alcohol functional groups, the hydrogen or functional group may be located at any point along the chain. Terminal groups have been found to be more effective.

As an example of a typical formulation and the best mode of carrying out my invention, a 2½% solution of $C_7F_{15}CH_2OH$ in DuPont KRYTOX TM -143AZ (having a Chemical Abstracts Registry Number of 52700-35-3 and identified as alpha-(heptafluoropropyl)-omega-(pentafluoroethoxy)-polyoxy-(trifluoro(trifluoro-methyl)-1,2-ethanediyl)) having an average molecular weight in the range 1800 to 1900, preferably 1850, is made by stirring the two components for 1 hour, under ambient or room conditions of temperature and pressure, although any method of obtaining such a solution may be used. The solution thus obtained provides better performance than either component separately. KRYTOX TM compounds useful herein are made in a wide variety of average molecular weights ranging from about 1800 to about 8500.

Figure 1:
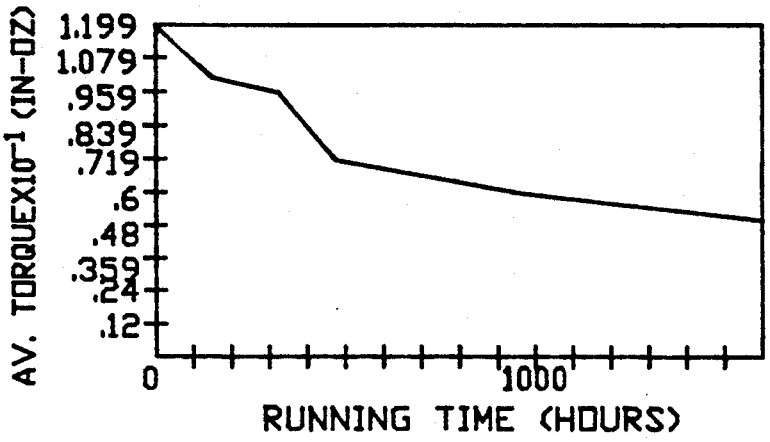
FIG. 1 is a graph of a life test over 1584 hours of ball bearing A showing the change in average torque in inch-ounces over predetermined running times (in hours) for neat KRYTOX TM -143AZ.

Referring now more particularly to the drawings, FIG. 1 is a torque trace for a ball bearing A run in KRYTOX TM -143AZ without an additive.

The preload data starts at an initial value of 8.84 pounds and drops to a value of 4.9 pounds after 1584 hours. This loss of preload (pressure between the balls and races) is due to wear and is consistent with the torque data. Preload can be measured to about 10%.

| BALL BEARING A | | |
|---|---|---|
| TEST NUMBER | RUNNING TIME (HOURS) | AV TORQUE (IN-OZ) |
| 0 | 1 | .12 |
| 1 | 168 | .1 |
| 2 | 336 | .095 |
| 3 | 480 | .07 |
| 4 | 960 | .05709 |
| 5 | 1584 | .04788 |

Figure 2:
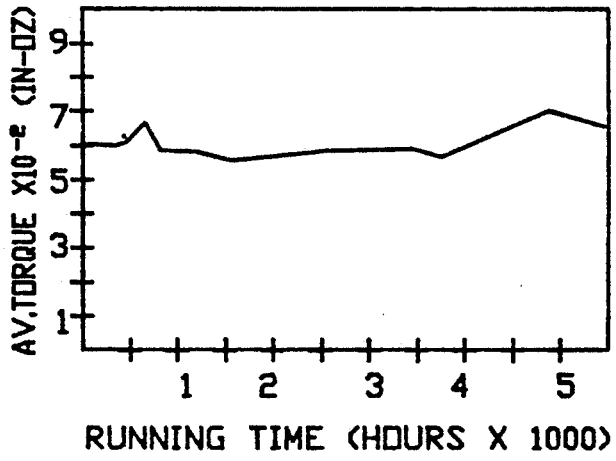
FIG. 2 is a graph like FIG. 1 showing the results obtained when 2.5% by weight of pentadecafluorooctanol is included in a 2-component composition. The duration of the test was 5166 hours, and showed no loss of pre-load in the ball bearing designated as bearing B.

FIG. 2 gives torque data for a ball bearing B which contained the subject type of additive. It is seen that, within the measurement capability, there is no torque reduction after 5166 hours. Also, the preload value is within experimental error (6.5# initially and 6.0# after).

The graph of FIG. 2 is based on the following raw data:

| BALL BEARING B<br>LUBRICATION: KRYTOX TM -2.5%<br>Pentadecafluorooctanol (PDFO) | | |
|---|---|---|
| TEST NUMBER | RUNNING TIME (HOURS) | AV TORQUE (IN-OZ) |
| 0 | 0 | .06722 |
| 1 | 79 | .06012 |
| 2 | 271 | .05911 |
| 3 | 415 | .06053 |
| 4 | 583 | .06717 |
| 5 | 775 | .0582 |
| 6 | 919 | .05836 |
| 7 | 1086 | .05802 |
| 8 | 1446 | .05575 |
| 9 | 2430 | .05966 |
| 10 | 3270 | .06013 |
| 11 | 3534 | .05798 |
| 12 | 4614 | .06993 |
| 13 | 5166 | .0652 |

Figure 3:
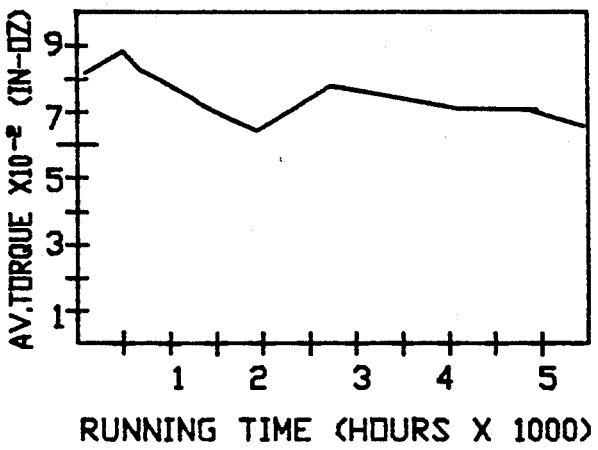
FIG. 3 is a graph like FIG. 1 showing the results obtained when 2.5% by weight of pentadecafluorooctanol is included in a 2-component composition with 97.5% by weight KRYTOX TM -143AZ with different ball bearing C over a period of 3884 hours. No loss in pre-load was observed.

FIG. 3 gives torque data for a ball bearing C which contained the subject type of additive. It is seen that, within the measurement capability, there is no torque reduction after 3884 hours. Also, the preload value is within experimental error (8.7# initially and 8.0# after). The graph is based on the following raw data:

| BALL BEARING C<br>LUBRICATION: KRYTOX TM 2.5% PDFO | | |
|---|---|---|
| TEST NUMBER | RUNNING TIME (HOURS) | AV TORQUE (IN-OZ) |
| 0 | 0 | .08866 |
| 1 | 308 | .09564 |
| 2 | 452 | .08942 |
| 3 | 620 | .08629 |
| 4 | 884 | .08061 |
| 5 | 980 | .07882 |
| 6 | 1148 | .07557 |
| 7 | 1412 | .07055 |
| 8 | 2084 | .08485 |
| 9 | 3164 | .07875 |
| 10 | 3884 | .07912 |

Figure 4:
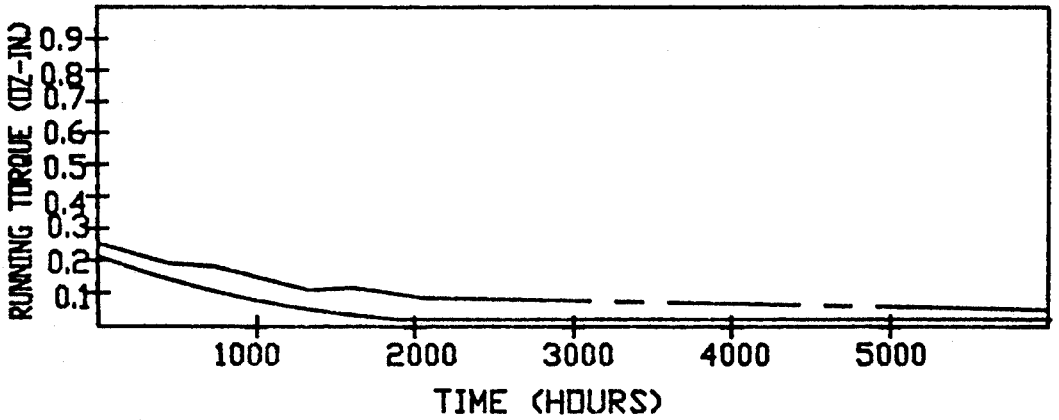
FIG. 4 is a graph showing the running torque plotted against time in hours. The lubricant was KRYTOX TM -143AZ neat in the bearing D, the retainer was Delrin, the preload was 16.1 lbs at the start and the temperature was 115° F. The dotted line shows the change in running torque in inch-ounces.

FIG. 4 gives running torque data for ball bearing D. This bearing was run in neat KRYTOX TM -143AZ with no additive. It is seen that the torque starts at a value above 0.2 then decreases to less than 0.5 within 2000 hours. This torque reduction is due to wear caused by excessive friction.

Figure 5:
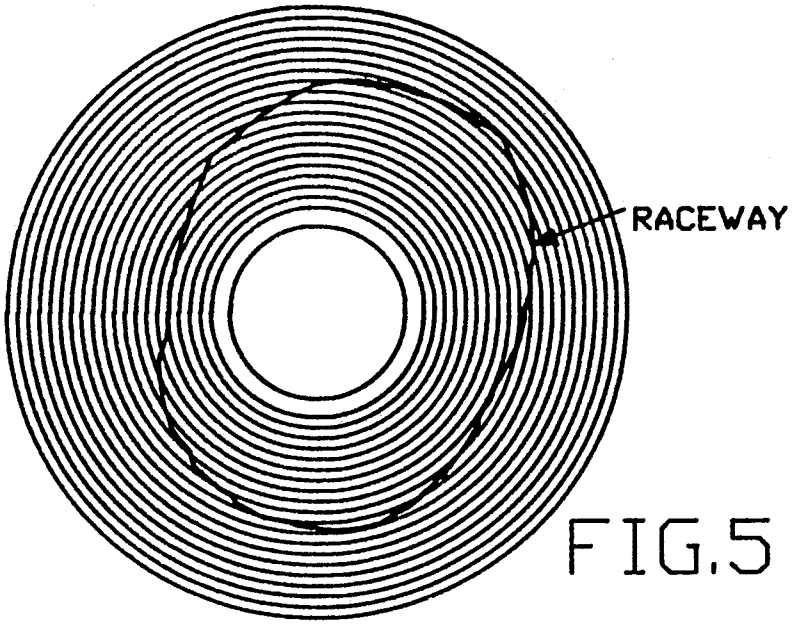
FIG. 5 is a profilometer trace of the ball raceway at the end of the run using Krytox-143AZ, neat. The distortion from circular shows wear measured circumferentially.
Figure 6:
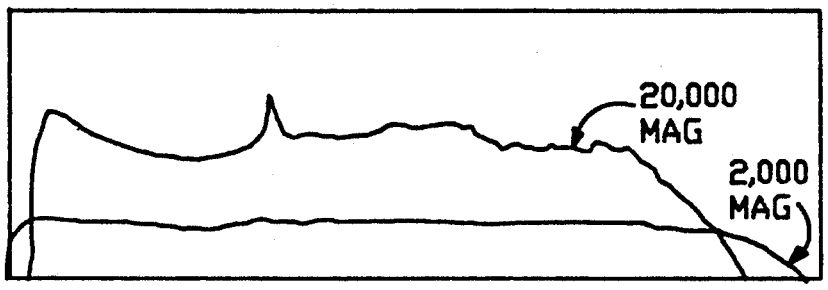
FIG. 6 is a profilometer trace of the ball raceway in an axial direction at the end of a run using KRYTOX TM -143AZ, neat.

FIG. 5 gives a profilometer trace for ball bearing D after operation. It is seen that the trace around the bearing is now elliptical in shape indicating wear which is consistent with the torque trace mentioned above. The trace across the race FIG. 6 is not a straight line which also indicates wear.

Figure 7:
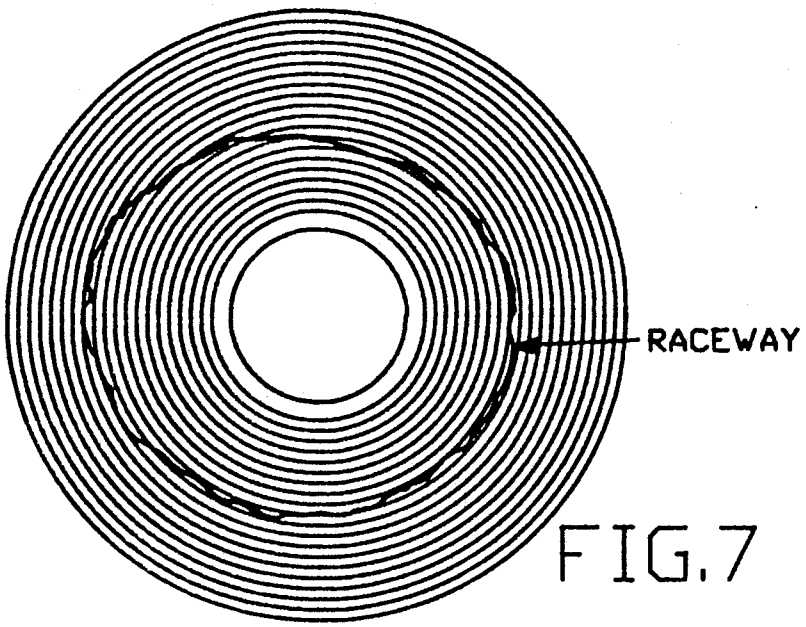
FIG. 7 is a profilometer trace of the ball raceway at the end of a run using Krytox-143AZ+2.5% pentadecafluorooctanol. Note the near circular trace. The divisions represent $10^{-6}$ inch.

FIG. 7 gives a profilometer trace for ball bearing D before operation. It is seen that the trace around the bearing is an almost perfect circle indicating that the initial geometry of the bearing is excellent.

Figure 8:
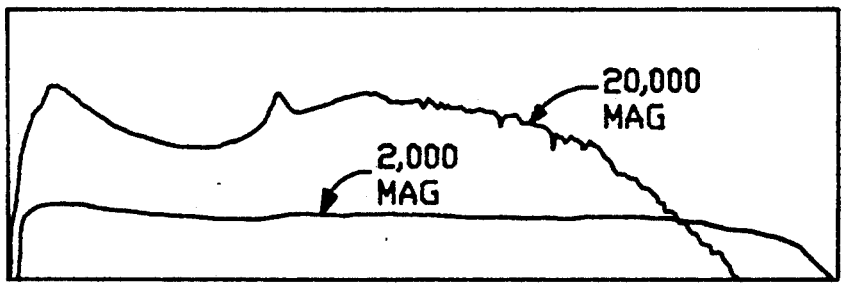
FIG. 8 is a profilometer trace of the ball raceway in an axial direction at the end of a run using the lubricant of FIG. 7.

The trace across the race FIG. 8 is closer to a straight line in the initial geometry.

| EXAMPLE | KRYTOX TM-143AZ | "R" | ALCOHOL A | ALCOHOL B | ALCOHOL C | ALCOHOL D | ALCOHOL E |
|---|---|---|---|---|---|---|---|
| 1 | 99.9 | 1 | 0.1 | | | | |
| 2 | 75 | 1 | 25.0 | | | | |
| 3 | 99.5 | 1 | | 0.5 | | | |
| 4 | 97.0 | 1 | | | 3.0 | | |

-continued

| EXAMPLE | KRYTOX TM-143AZ | "R" | ALCOHOL A | ALCOHOL B | ALCOHOL C | ALCOHOL D | ALCOHOL E |
|---|---|---|---|---|---|---|---|
| 5 | 97.5 | 1 | | | | 2.5 | |
| 6 | 90.0 | 1 | | | | | 10.0 |
| 7 | 99.9999 | 1 | 0.0001 | | | | |
| 8 | 80.0 | 1 | | 20.0 | | | |
| 9 | 90.0 | 1 | 0.5 | | | 0.5 | |
| 10 | 51.0 | 1 | 49.0 | | | | |
| 11 | 97.5 | 2 | 2.5 | | | | |
| 12 | 99.9 | 2 | 0.1 | | | | |
| 13 | 80.0 | 3 | | | 20.0 | | |
| 14 | 75.0 | 4 | 15.0 | | | | 10.0 |

Alcohol A = pentadecafluorooctanol
Alcohol B = 1,1,2,2-tetrahydroperfluorononyl alcohol
Alcohol C = 1,1-dihydroperfluorohexyl alcohol
Alcohol D = perfluorocyclohexyl alcohol
Alcohol E = pentadecafluorooctanol-3

Other fluorinated compounds, for example alcohols such as 1-methyl-1,2,2-trihydroperfluoro-nonyl alcohol, perfluorooctadecanol-1, perfluorododecanol-1, perfluoroeicosanol-1, may be used to replace part or all of the pentadecafluorooctanol described above. Still other examples will be found in U.S. Pat. No. 3,283,012 which is incorporated herein by reference.

The major improvement in this invention over prior art methods is that the additive and the fluid are mutually soluble, therefore the additive is continuously available to the bearing surface during operation. Also the previously recommended step of carefully applying a uncontrolled amount of lubrication during fabrication is avoided. Also improved performance is observed when compared to the case when no additive is used.

The novel feature of this invention is that an effective additive which is soluble in highly fluorinated fluids has been blended with highly fluorinated polyether fluids to provide previously unattainable performance and wear reduction.

Commercial applications include precision bearings, high reliability bearings, and lubrication systems requiring long life, low wear and high performance such as is found in vacuum pump lubricating fluids. The term "bearing" is used to mean any two relatively moving surfaces.

What is claimed is:

1. A lubricant consisting essentially of component (a) from about 50 parts to about 99.9999 parts by weight of a perfluorinated polyether selected from the group consisting of perfluorinated polyethers having the general formula:

$$F-\left[\underset{\underset{R}{|}}{CF}-CF_2-O\right]_n-CF_2-CF_3$$

where n is an integer in the range of from 10 to 60 and R is a fluorine atom or a perfluorinated alkyl group containing from 1 to 4 carbon atoms; perfluorinated polyethers having the general formula:

$$R_f(C_3(F_6O)_p(CF_2O)_q(C_2F_4O)_r-R'_f$$

wherein p, q, and r are the same or different integers and p+q+r is an integer in the range of 10–60, and $R_f$ and $R'_f$ are the same or different perfluorinated alkyl groups containing from 1 to 4 carbon atoms; perfluorinated polyethers having the general formula:

$$R_f(OCF_2CF_2CF_2)_nOR'_f$$

wherein n, $R_f$ and $R'_f$ have the meanings ascribed above; and perfluorinated alkylamines; and (b) from about 0.0001 to about 50 parts by weight of pentadecafluorooctanol.

2. A lubricant as defined in claim 1 wherein component (a) is a perfluorinated polyether having the general formula:

$$R_f(C_3F_6O)_p(CF_2O)_q(C_2F_4O)_r-R'_f$$

wherein p, q and r are the same or different integers and (p+q+r) is an integer in the range of 10 to 60, and $R_f$ and $R'_f$ are the same or different perfluorinated alkyl groups containing from 1 to 4 carbon atoms.

3. A lubricant as defined in claim 1 wherein component (a) is a perfluorinated polyether having the general formula:

$$R_f(OCF_2CF_2CF_2)_nOR'_f$$

wherein n is an integer from 10 to 60 and $R_f$ and $R'_f$ are the same or different perfluorinated alkyl groups containing from 1 to 4 carbon atoms.

4. A lubricant as defined in claim 1 wherein component (a) is a perfluorinated alkylamine.

5. A lubricant as defined in claim 4 wherein the perfluorinated alkylamine is 1,1,2,2,3,3,4,4,4-nonafluoro-N,N-bis(nonafluorobutyl)-1-butanamine.

6. A lubricant as defined in claim 1 wherein the amount of component (a) is in the range of from 96% to 99.5 parts by weight, and the amount of component (b) is in the range of from 4 to 0.5 parts by weight.

7. A lubricant as defined in claim 1 wherein component (a) is alpha-(heptafluoropropyl)-omega-(pentafluoroethoxy)-polyoxy-(trifluoro(tri-fluoromethyl)-1,2-[ethanediy]-ethanediyl).

8. A lubricant as defined in claim 1 wherein the amount of component (a) is 97.5 parts by weight and the amount of component (b) is 2.5 parts by weight, and the average molecular weight of component (a) is in the range of from 1800 to 8300.

9. A lubricant as defined in claim 8 wherein component (a) has an average molecular weight in the range of 1800 to 1900.

10. A lubricant as defined in claim 9 wherein component (a) has a maximum volatility of 50% at 400° F., and a maximum pour point of 50° F.

11. A lubricant consisting essentially of component (a) from about 50 parts to about 99.9999 parts by weight of a perfluorinated polyether selected from the group consisting of perfluorinated polyethers having the general formula:

$$F\left(\underset{\underset{R}{|}}{CF}-CF_2-O\right)_n CF_2CF_3$$

where n is an integer in the range of from 10 to 60 and R is a fluorine atom or a perfluorinated alkyl group containing from 1 to 4 carbon atoms; perfluorinated polyethers having the general formula:

$$R_f(C_3F_6O)_p(CF_2O)_q(C_2F_4O)_r R'_f$$

wherein p, q, and r are the same or different integers and p+q+r is an integer in the range of 10–60 and $R_f$ and $R'_f$ are the same or different perfluorinated alkyl groups containing from 1 to 4 carbon atoms; perfluorinated polyethers having the general formula:

$$R_f(OCF_2CF_2CF_2)_n OR'_f$$

wherein n, $R_f$ and $R'_f$ have the meanings ascribed above; and perfluorinated alkylamines; and component (b) from about 0.0001 to about 50 parts by weight of a perfluoroalkanol having the general formula $R_fCH_2OH$ wherein $R_f$ is a perfluroinated alkyl group containing from 1–20 carbon atoms.

12. A lubricant as defined in claim 11 wherein said component (b) comprises a compound having from 6 to 20 carbon atoms.

13. A lubricant as defined in claim 11 wherein said component (b) contains an aliphatic group having a chain structure which includes one or more of oxygen, nitrogen, phosphorous, sulfur, selenium and boron attached to or interposed between carbon atoms.

* * * * *